United States Patent [19]

Gelinas

[11] Patent Number: 4,495,727

[45] Date of Patent: Jan. 29, 1985

[54] ANTI-THEFT WINDOW BAR

[76] Inventor: Réjean Gelinas, 2519 Père Daniel St., Trois-Rivières, Canada, G8Z 2K7

[21] Appl. No.: 506,397

[22] Filed: Jun. 17, 1983

[51] Int. Cl.[3] ..... E06B 3/68

[52] U.S. Cl. ..... 49/56

[58] Field of Search ..... 49/50, 55–57; 52/507

[56] References Cited

U.S. PATENT DOCUMENTS

| | | | |
|---|---|---|---|
| 1,954,559 | 4/1934 | Crandall | 49/55 |
| 4,026,070 | 5/1977 | Hicks | 49/55 |
| 4,162,590 | 7/1979 | Earley | 49/55 |
| 4,416,084 | 11/1983 | Zen | 49/50 |

*Primary Examiner*—Kenneth Downey

[57] ABSTRACT

An anti-theft window guard comprising laterally-spaced hollow vertical posts secured at their respective opposite ends to a window frame by holder elements. The latter are formed with a flat seating flange and at least one inwardly-projecting dowel pin adapted to be removably fixed in the posts. At least two vertically-spaced horizontal rod members are adapted to extend through the vertical posts. In one embodiment, the grill structure defined by the posts and rod members is hingedly secured to the upper rail of the window frame and a locking device at the lower rail is provided. All embodiments are made of separate elements which can be easily cut to size, assembled and installed.

1 Claim, 8 Drawing Figures

ANTI-THEFT WINDOW BAR

FIELD OF THE INVENTION

The present invention relates to window guards, more specifically to an improved such guard, which is easily and quickly assembled and secured to variously-sized window frames.

BACKGROUND OF THE INVENTION

Window guards designed to discourage thieves or prevent small children from falling through a window are well known. For example, the Canadian Pat. No. 471,248, issued Feb. 6, 1951 to Hawkins et al, discloses "burglar bars" adapted to fit into window frames of different widths, but not necessarily heights. The guard is secured by a set-screw means in a hole covered with putty and paint after installation and needs a special tool for removal.

Another Canadian Pat. No. 507,899, dated Dec. 7, 1954, issued to Montafusco, teaches the use of a relatively complex assembly specifically designed for installation in sash windows.

In the U.S. art, by way of example, the patent to Crandall bearing U.S. Pat. No. 1,954,559, and issued Apr. 10, 1934, makes use of a plurality of twisted vertical bars threaded into horizontal members and kept in place by a barrel-type lock which might be tampered with fairly easily by a thief. Yet another U.S. patent to Hutchisson Jr. bearing U.S. Pat. No. 3,167,828, issued Feb. 2, 1965 discloses a device which is also specifically applicable to sash windows and which can assume only a partial "knock-down" condition when not in use.

OBJECTS OF THE INVENTION

In view of the above-noted disadvantages in the prior art, it is an important object of the present invention to provide a window guard which is thoroughly theft-proof and made of separate pieces easily cut to size, assembled and installed.

It is another object of the invention to provide a window guard of the above type, which is adapted to fit any standard window and which is non-costly to produce.

SUMMARY OF THE INVENTI0N

The above and other objects of the present invention are realized according to preferred embodiments comprising, for installation in an ordinary window frame, at least two laterally-spaced vertical hollow posts. The opposite ends of each post are held in the frame by a holder element, the latter having an outer flat seating flange adapted to be fixed to the window frame. Each holder element has one or more dowel pins slidably extending into the respective posts at the opposite ends thereof. At least one horizontal bar, or rod member, is adapted to slidably extend at least partially through the two posts, thereby forming a rigid grill structure in the window frame. In this manner, two posts can be secured in rigid spaced-apart relationship by upper and lower holder elements extending into the two opposite ends of each post.

According to the alternate embodiment of the invention, the grill structure is hingedly secured to the upper rail of the window frame, such that it can be swung outwardly upwardly if access to the window is necessary. An effective lock means is provided in this embodiment to prevent unauthorized egress or ingress through the window frame. The lock means is easily released.

BRIEF DESCRIPTION OF THE DRAWINGS

The above will be more clearly understood by having referral to the preferred embodiments of the invention, illustrated by way of the accompanying drawings, in which.

Like numerals refer to like elements throughout the drawings.

DETAILED DESCRIPTION OF THE PREFERRED EMBODIMENT

The anti-theft window guard 1 is adapted for removable installation in a window frame, the latter having wooden or metallic stiles 3 and upper and lower rails 4, 5.

Figures 4, 5, 6, 7, 8:
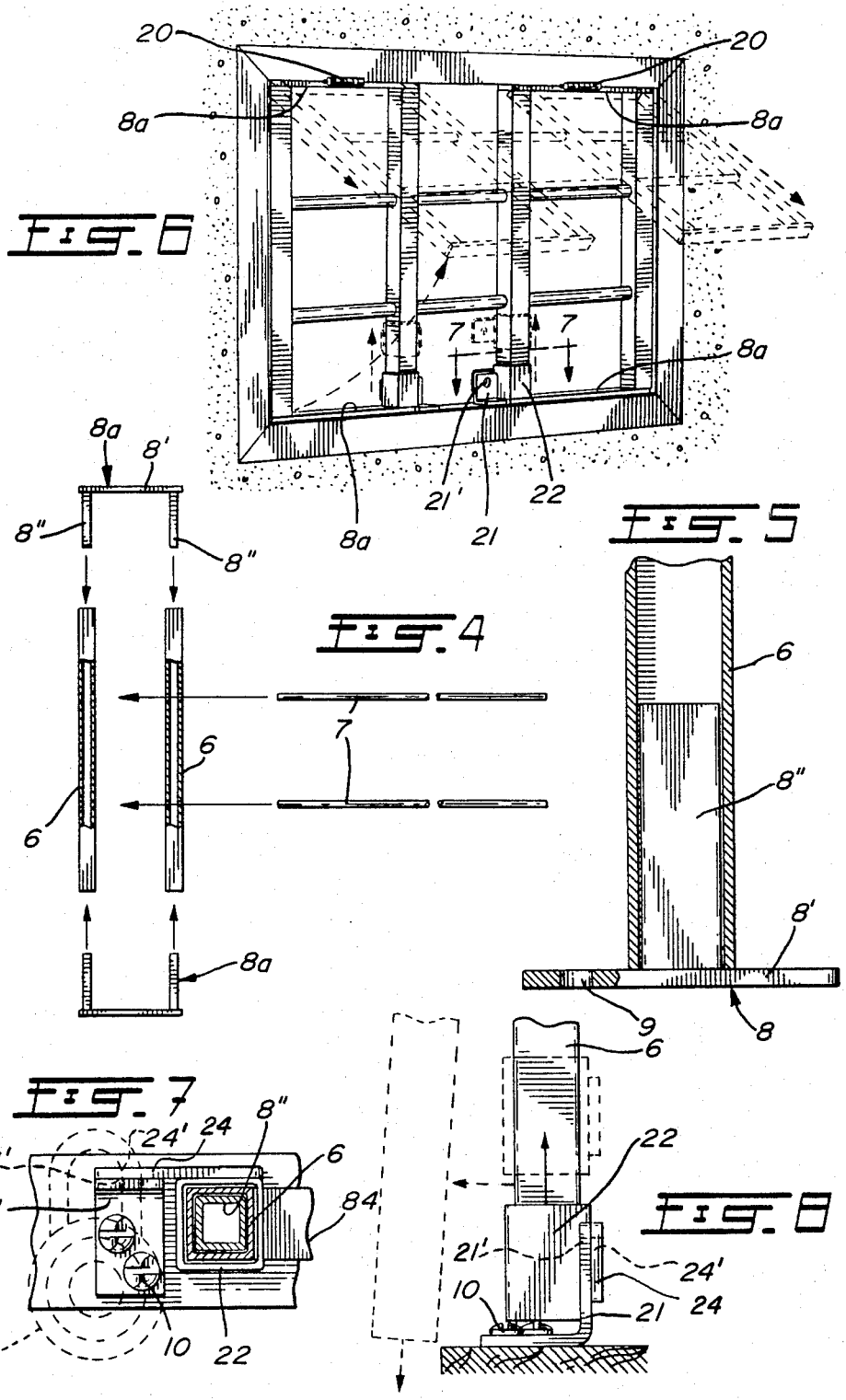
FIG. 4 is an exploded elevational view, partly in section, of double pin holder elements, two vertical posts and two horizontal rod members.
FIG. 5 is an elevation view of a single pin holder element in position in a vertical post shown in longitudinal section.
FIG. 6 is an elevation view of a fourth embodiment of the invention installed in a window frame.
FIG. 7 is a top plan view of the lock means shown in FIG. 6, taken along line 7—7 of the latter.
FIG. 8 is a side elevation of the lock means.

FIGS. 4 and 5 illustrate the novel and essential features of the invention, consisting of vertical hollow posts 6 and horizontally-extending rigid bars or rods 7. These latter are each removably inserted in vertically-spaced relationship through holes 6' made in posts 6.

Posts 6, of which there are at least two, are held in position in frame 2 by holder element 8.

FIG. 5 shows a first holder element 8 having an outer flat seating flange 8' and a single inwardly-projecting pin 8'' which removably fits into the corresponding opposite ends of each post 6. Seating flange 8' abuts its respective upper and lower rail 4, 5, being secured thereto by screws 10 which are retained in holes 9 on either side of pin 8''.

Screws 10 are preferably of the type which cannot be unscrewed.

Figure 1:
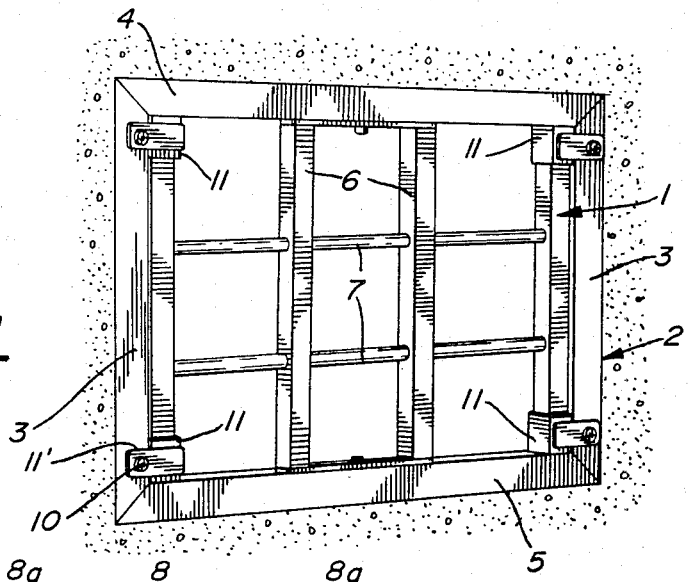
FIG. 1 is a perspective view of a first embodiment of the invention installed in a window frame.
Figure 2:
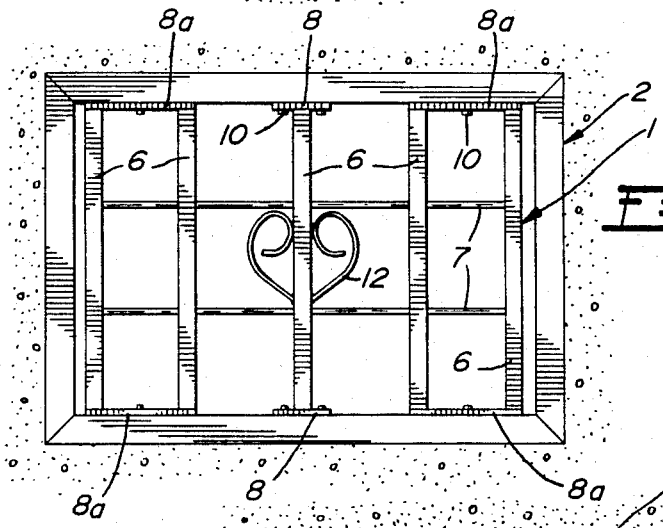
FIGS. 2 and 3 are elevation views of the second and third embodiments, respectively, installed in a window frame.

FIG. 4 shows a second holder element **8*a*, also having a flat seating flange 8', but being provided with two inwardly-projecting pins 8'', clearly shown in FIGS. 1 and 2; second holder elements 8*a* maintain posts 6 in rigid lateral spacing when in position in frame 2**.

FIG. 1 depicts a rigid grill structure including an upper and lower second holder **8*a* retaining two central posts 6 in position. Holders 8*a* are in turn fixed to the frame 2 by screws 10. Two outer posts 6 are further provided in this embodiment and are held in frame 2 at their opposite ends by a fastening means consisting of a collar member 11 removably surrounding the opposite ends of posts 6 and provided with a flange member 11' which is secured by screw 10 to the facing portions of each stile 3. Two rod members 7** complete the grill structure.

FIG. 2 shows a preferred embodiment wherein two pairs of outermost posts 6 are held by second holder members 8*a*, while a fifth central post 6 is held by two first holder elements 8.

If desired, the grill structure can be embellished by an ornamental fixture 12.

Figure 3:
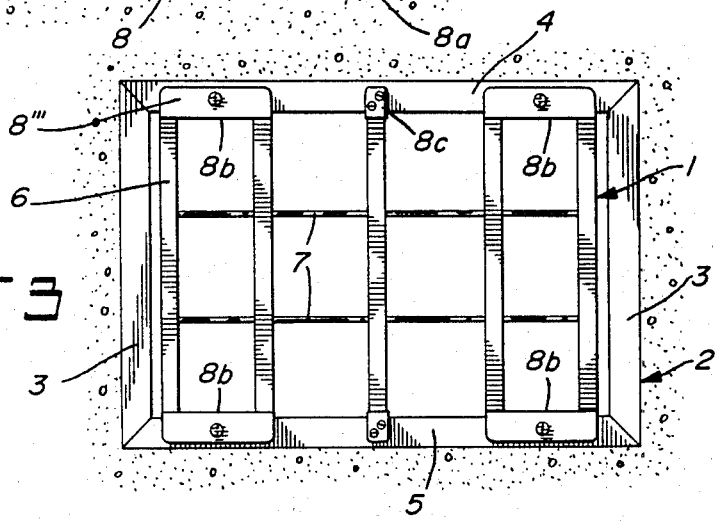

Referring to FIG. 3, there is shown a third embodiment of the invention. Two pairs of laterally-spaced posts 6 are interconnected at their opposite ends by a holder member 8*b* provided with an orthogonal flange 8''' secured to the facing portion of frame 2 by screws 10. A central post 6 is secured to the frame 2 by upper and lower single pin holder elements 8*c*, each provided with another short orthogonal flange 8''' secured to the facing portion of rails 4, 5. Horizontal rods 7 are also provided. It will be clear that flanges 8''' are preferably secured on the interior side of window frame 2 to prevent tampering therewith.

Referring now to FIGS. 6 to 8, there is shown a fourth embodiment of the invention, comprising two pairs of laterally-spaced posts 6, each pair held together by upper and lower double pin holder elements 8*a*, as in FIG. 2. The top holder elements 8*a* are each hingedly secured to the upper rail 4 by a hinge 20. Thus, the entire grill structure or guard can be pivoted upwardly and outwardly to permit escape in case of fire or the like. When pivoted, the various parts become disassembled to provide an unobstructed escape passage.

Lock means are provided to keep the grill structure of FIG. 6 in position, consisting of a rigid L-shape tab 21 secured adjacent each inner post 6 to rail 5, and upstanding therefrom. The upstanding portion of each tab 21 is formed with a hole 21'. Both inner posts 6 are further each provided with a vertically-slidable collar member 22, similar to collar 11, which surrounds its respective post and has a laterally-projecting flange 24. The latter is provided with a hole 24' adapted to register with hole 21' when member 22 is in lowermost locking position. Flange 24 extends behind tab 21 in this position. An ordinary padlock 25 is looped through holes 21', 24'.

The rods 7 and tubular posts 6 can be easily cut to size by the home occupant and installed using the required number of single pin or double pin holders 8, 8*a* and/or 8*b*, 8*c* in accordance with the size of the windows to be guarded.

What I claim is:

1. An anti-theft window guard for securing to a window frame, comprising two laterally-spaced hollow posts; a holder element associated with both opposite ends of said two posts; each said holder element having an outer flat seating flange adapted to extend within said window frame and two spaced dowel pins extending away from said flange and slidably extending within respective ends of said hollow posts, rod members slidably extending at least partially through holes made therefor in each said vertical post, with said rod members extending transversely of said posts, whereby a rigid grill structure can be formed in said window frame from separate holder elements, hollow posts and rod members, those of said holder elements at the top of said grill structure having hinges to hingedly secure said last-named holder elements to the upper rail of said window frame, and further including lock means to releasably keep the grill structure in operative position within the window frame, said lock means comprising an L-shape tab adapted to be secured to the lower rail of said window frame adjacent the lower end of one of said posts and having an upstanding portion formed with a hole, a collar member slidably surrounding said one of said posts and provided with a laterally-extending flange portion provided with a hole adapted to register with the first-mentioned hole; said two holes, when in registry, adapted to receive the bolt of a padlock.

* * * * *